US006166701A

United States Patent [19]

Park et al.

[11] Patent Number: 6,166,701

[45] Date of Patent: Dec. 26, 2000

[54] DUAL POLARIZATION ANTENNA ARRAY WITH RADIATING SLOTS AND NOTCH DIPOLE ELEMENTS SHARING A COMMON APERTURE

[75] Inventors: Pyong K. Park, Tucson, Ariz.; Steven E. Bradshaw, West Hills; Steven W. Bartley, Thousand Oaks, both of Calif.; Joseph M. Anderson; Sang H. Kim, both of Tucson, Ariz.; David Y. Kim, Northridge, Calif.

[73] Assignee: Raytheon Company, Lexington, Mass.

[21] Appl. No.: 09/369,129

[22] Filed: Aug. 5, 1999

[51] Int. Cl.[7] ..... H01Q 13/10

[52] U.S. Cl. ..... 343/771; 343/756; 333/21 A

[58] Field of Search ..... 343/767, 770, 343/771, 700 MS, 756, 909; 333/21 A, 137

[56] References Cited

U.S. PATENT DOCUMENTS 5,023,623 6/1991 Kreinheder et al. ..... 343/770

5,467,100 11/1995 Chen ..... 343/770

5,473,334 12/1995 Yee et al. ..... 343/756

5,579,019 11/1996 Uematsu et al. ..... 343/771

6,043,785 3/2000 Marino ..... 343/770

*Primary Examiner*—Tan Ho

*Attorney, Agent, or Firm*—David W. Collins; Andrew J. Rudd; Glenn H. Lenzen, Jr.

[57] ABSTRACT

Disclosed is a common aperture dual polarization antenna array (30). This common aperture dual polarization antenna array (30) includes an antenna aperture (36) and a plurality of centered slot arrays (32) positioned within the antenna aperture (36). A plurality of notch dipole arrays (34) are positioned within the antenna aperture (36) and positioned substantially orthogonal to the plurality of centered slot arrays (32). A first feed guide (46) is coupled to the plurality of centered slot arrays (32) and a second feed guide (56) is coupled to the plurality of notch dipole arrays (34).

20 Claims, 3 Drawing Sheets

DUAL POLARIZATION ANTENNA ARRAY WITH RADIATING SLOTS AND NOTCH DIPOLE ELEMENTS SHARING A COMMON APERTURE

This invention was developed in whole or in part with U.S. Government funding. Accordingly, the U.S. Government may have rights in this invention.

BACKGROUND OF THE INVENTION

1. Field of the Invention

The present invention relates to an antenna array and, more particularly, to a dual polarization antenna array having radiating slots and notch dipole elements sharing a common antenna aperture.

2. Description of Related Art

Radar and communication systems commonly use dual polarized antennas which are capable of achieving significant performance advantages over single polarization antenna arrangements. Current trends in radar and communication antenna designs emphasize the reduction of cost and volume of the dual polarization antenna, while achieving high performance. The dual polarization antenna is particularly useful with energy waves such as those employed in the radio frequency spectrum having two orthogonal components which are orthogonally polarized with respect to each other. The first orthogonal component is conventionally known as the vertical or principle polarization component, while the second component is generally known as the horizontal or cross polarization component. The orthogonal polarization of the energy waves allows for the possibility of broadcasting two different signals at the same operating frequency. In doing so, one signal is derived from the principle polarization component and the second signal is derived from the cross polarization component.

The more basic conventional antenna systems are capable of employing the orthogonally polarized signal components to double the information sent at the same frequency by using two separate antennas. One type of conventional dual polarization antenna utilizes a reflector antenna with dual polarization feed elements. This reflector antenna consumes a large volume and is therefore bulky by today's standards. In addition, the conventional reflector arrangement can exhibit a relatively poor efficiency as compared to other types of antennas and often experiences poor isolation between the two polarizations. The conventional dual polarization reflector antenna is also limited in its ability to offer low sidelobe radiation pattern performance.

Another type of dual polarization antenna includes an array of dual polarized patches typically made up of conductive patches fabricated on a dielectric substrate. The dual polarized patch antenna can be manufactured at a low cost and provides for a low profile antenna configuration. However, the bandwidth of each element of the dual polarized patch antenna is typically quite narrow and therefore it is very difficult to achieve a high antenna performance with the patch antenna. Also, the efficiency of the dual polarized patch array antenna can be quite low due to the presence of undesirable dielectric losses.

Another antenna includes a dual polarization rectangular waveguide array 10, as shown in FIG. 1, which consists of a stack up of rectangular waveguide fed offset longitudinal slot arrays 12 and waveguide fed tilted edge slot arrays 14. The offset slots 16 on the longitudinal slot arrays 12 excites both the desirable TEM mode and the undesirable $TM_{01}$ odd mode in the parallel plate region formed by the edge slot arrays 14 (see FIG. 1). This undesirable $TM_{01}$ odd mode exhibits poor performance. The excited $TM_{01}$ odd mode also causes high sidelobes and RF loss. A further limitation in performance of this type of antenna results from the coupling between arrays 12 and 14 caused by the tilted edge slots 18 of the edge slot arrays 14 containing a cross polarization component.

A further approach includes arched notch dipole card arrays 20, as shown in FIG. 2, erected over a rectangular waveguide fed offset longitudinal slot arrays 22. The arched notch dipole card arrays 20 have arches 24 provided to improve the performance of the principal-polarization slot arrays 22 and minimize interactions between the two arrays 20 and 22. However, this type of antenna is difficult to design due to the lack: of a convenient method to account for the presence of the arched dipole arrays 20 in the design of the slot arrays 22. Also, the requirement to maximize the spacing between the face of the slot arrays 22 and the arch arrays 20 to reduce interaction conflicts with the desire to place the notch radiators 26 one-quarter wavelength above the slot array surface for optimal image current formation. Moreover, this limitation becomes especially severe at higher frequencies of operation.

It is therefore desirable to provide for a compact low cost dual polarization antenna array which achieves high performance. More particularly, it is desirable to provide for a dual polarization antenna array which shares a common aperture of radiating slots and notch dipole elements at a low cost and yet exhibits high antenna performance.

SUMMARY OF THE INVENTION

In accordance with the teachings of the present invention, a common aperture dual polarization antenna array is provided for achieving high antenna performance at a low cost and in a compact structure. The common aperture dual polarization antenna array provides high gain and low sidelobe performance for both the principle polarization and cross polarization of the antenna array.

In one preferred embodiment, the common aperture dual polarization antenna array includes an antenna aperture and a plurality of centered slot arrays positioned within the antenna aperture. A plurality of notch dipole arrays are positioned within the antenna aperture and positioned substantially orthogonal to the plurality of centered slot arrays. A first feed guide is coupled to the plurality of centered slot arrays and a second feed guide is coupled to the plurality of notch dipole arrays.

In another preferred embodiment, the common aperture dual polarization antenna array includes a principle polarization array having a plurality of principle polarized radiators which are operable to radiate principle polarized energy. A cross polarization array having a plurality of cross polarized radiators is operable to radiate cross polarized energy. A polarization selective ground plane is operable to simultaneously reflect substantially all of the cross polarized energy radiated from the plurality of cross polarized radiators and simultaneously pass substantially all of the principle polarized energy radiated from the plurality of principle polarized radiators.

Use of the present invention prides a common aperture dual polarization antenna array which provides high gain and low sidelobe performance for both polarizations. As a result, the aforementioned disadvantages associated with current dual polarization antenna arrays have been substantially eliminated.

BRIEF DESCRIPTION OF THE DRAWINGS

Other objects and advantages of the present invention will become apparent to those skilled in the art upon reading the following detailed description and upon reference to the drawings in which.

DESCRIPTION OF THE PREFERRED EMBODIMENT

Figure 3:
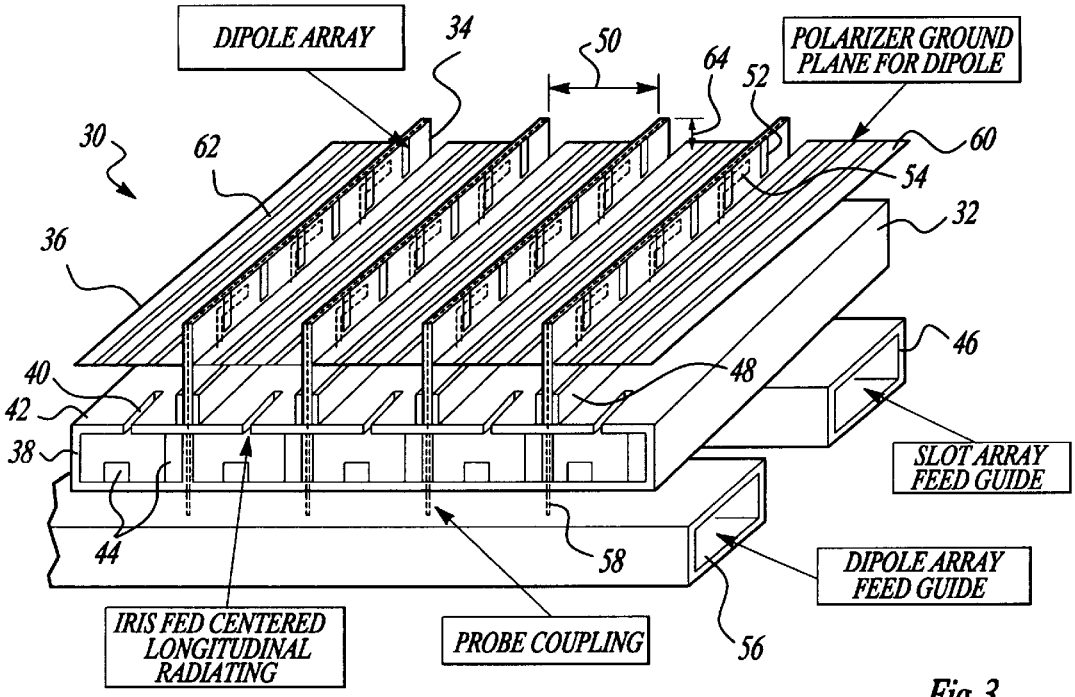
FIG. 3 is a side perspective view of a common aperture dual polarization antenna array in accordance with the teachings of the present invention.

A dual polarization antenna array 30 according to the teachings of the preferred embodiment of the present invention is shown in FIG. 3 generally made up of a combination of radiating slots and notch dipole elements provided in one common aperture. This invention provides a low cost, low profile and high performance dual polarization antenna array 30 that is particularly useful in electrically medium to large size array applications. The dual polarization antenna array 30 as described herein has potential applications suitable where high efficiency, low sidelobes and high isolation are required in a dual polarized antenna array at low to moderate costs and is particularly attractive for use in high performance missile seeker applications. However, it should be appreciated that various other modifications and applications of the dual polarization antenna array 30 are conceivable.

The dual polarization antenna array 30 includes a plurality of rectangular waveguide fed centered shunt slot arrays 32 each positioned parallel to one another and a plurality of stripline fed notch dipole arrays 34 each positioned perpendicular between adjoining centered shunt slot arrays 32. The main or principle (vertical polarization) array is achieved with the plurality of centered shunt slot arrays 32 and the cross (horizontal polarization) array is achieved with the plurality of notch dipole arrays 34. The fully populated main or principle polarization array formed by the centered shunt slot arrays 32 and the fully populated cross polarization array formed by the notch dipole arrays 34 each share a common aperture 36 defined by the outer periphery of the combination of the arrays 32 and 34.

Each centered shunt slot array 32 includes a rectangular waveguide 38 having a plurality of principle polarized radiators or longitudinally centered shunt slots 40 disposed on a broad wall 42 of the rectangular waveguide 38. Each longitudinally centered shunt slot 40 is fed by corresponding offset ridge resonant irises 44 which are disposed within the rectangular waveguide 38 and centered under each centered shunt slot 40, further discussed herein. The centered shunt slots 40 may also be excited by "L"-shaped resonant irises or other suitable means. Usable RF bandwidth of each centered shunt slot array 32 is inversely proportional to module size or the number of centered shunt slots 40 in a single standing wave rectangular waveguide 38. Each rectangular waveguide 38, is preferably fed by a rectangular slot array feed guide 46, or other appropriate feed arrangement.

Each notch dipole array 34 is secured perpendicular between adjacent rectangular waveguides 38 by the use of a pair of vertical retaining walls 48. The parallel plates formed by each of the notch dipole arrays 34 are each positioned at about one-half to three-quarters of a wavelength (0.50λ to 0.75λ) apart in free space, identified by reference numeral 50. The cross polarized radiators of the notch dipole arrays 34 consist of constant width notch radiators 52 arranged along the edge of the vertically disposed notch dipole arrays 34 and embedded dipoles 54. The notch radiators 52 are excited by the embedded dipole or balun elements 54, further discussed herein. Each notch dipole array 34 is fed by a rectangular dipole array feed guide 56, via a probe coupling element 58. Each probe coupling element 58 is located between and at the end corners of the centered shunt slot arrays 32, such that the probe element 58 can penetrate into the dipole array feed guide 56 without interrupting the main (vertical-polarization) array formed by the plurality of centered shunt slot arrays 32.

Positioned substantially parallel with the shunt slot arrays 32 and substantially perpendicular to the notch dipole arrays 34 is polarization selective ground plane 60. The polarization selective ground plane 60 includes a series of parallel conductive or metal strips 62 each arranged along the radiating dipole direction. The metal strips 62 simultaneously reflect substantially all of the cross polarized energy radiated from the notch dipole arrays 34 but simultaneously passes substantially all of the principle polarized energy radiated from the centered shunt slot arrays 32. This enables both sets of arrays 32 and 34 to radiate simultaneously without any substantial coupling between the arrays 32 and 34. In other words, the parallel strips 62 act as a ground plane for the notched dipole arrays 34 but are substantially invisible or transparent to the centered shunt slot arrays 32, thereby further enhancing the isolation between the two orthogonal polarized arrays. The polarization selective ground plane 60 is preferably located one-quarter wavelength (¼λ) below the top of the notch dipole arrays 34, identified by reference numeral 64, thereby providing image currents which add in phase near broadside in the far field radiation pattern. It should further be noted that each notch dipole array 34 has a height that is much larger than one-quarter free space wavelength (¼λ) to accommodate for the stripline feed circuitry of each notch dipole array 34 which enables improved bandwidth.

Figure 4:
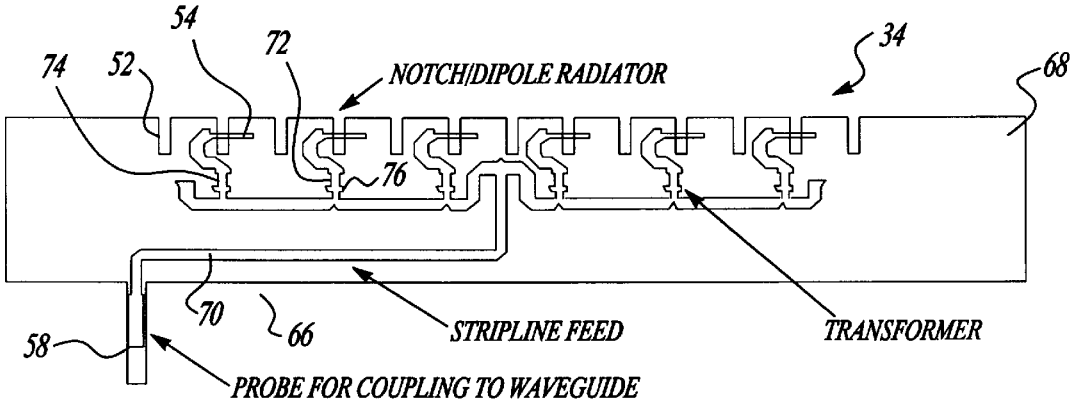
FIG. 4 is a planar view of the circuit layout for a notch dipole array in accordance with the teachings of the present invention.
Figure 5:
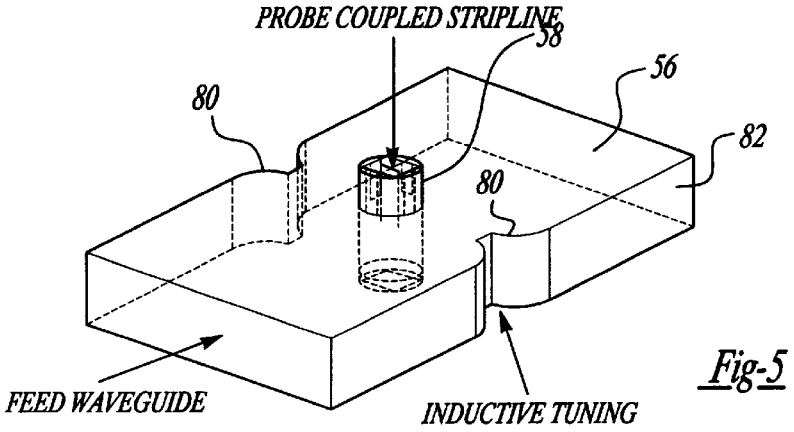
FIG. 5 is a perspective view of an inductive tuning performed on a notch dipole array feed guide in accordance with the teaching of the present invention.

Turning to FIGS. 4 and 5, a notch dipole array 34 and the rectangular dipole array feed guide 56 are shown in detail. The notch dipole array 34 is made of a bonded assembly of two (2) 15 mils thick duroid boards with a conductive stripline feed circuitry 66 positioned therebetween, and shown here in solid lines. The notch radiators 52 are formed on the outside of the bonded assembly by etching the notch radiators 52 out of two (2) solid ground planes 68 which are also bonded to the outside of the duroid boards. Each notch dipole array 34, shown in FIG. 4, includes a plurality of notch radiators 52 etched within the ground plane 68 and six (6) radiating dipoles or baluns 54 which form a portion of the conductive stripline circuitry 66. Each dipole 54 is located orthogonal to every other notch radiator 52. Each dipole 54 is fed from the probe element 58 through a conductive stripline feed 70 and separate stripline transformers 72. It should be noted that the notch dipole array 34, shown in FIG. 4, includes the six (6) radiating dipoles 54 while the arrays 34, shown in FIG. 3, only show a portion or section of the arrays 34. Moreover, the dual polarization antenna array 30, shown in FIG. 3, is shown with four (4) notch dipole arrays 34 and five (5) centered shunt slot arrays 32 for merely exemplary purposes and may include more or less arrays 32 and 34.

The width of each transformer 72 controls the amount of excitation or impedance. The notches 74 and tabs 76 on the transformers 72 are used to compensate for junction reactance and radiation phase errors. The purpose of the notches 72 and tabs 76 is to make each antenna radiator equivalent circuit element look purely shunt to the main stripline feed circuitry 66. Desired sidelobe levels for antenna 30 require a preferable conductance range of about 3.5 to 1 for the transformers 72. This implies that over this conductance range, the radiation phase and the insertion phase need to be constant. The amount of excitation or the impedance can also be adjusted by adjusting the stripline 70 and dipole 54 geometries, using known techniques. The bandwidth is controlled by subdividing each notch dipole array 34 into modules through the use of known equal or unequal power dividers which may be embedded within each notch dipole array 34. Packaging space for the conductive strip line feed circuitry 66 is available because of the use of the polarization selective ground plane 60 positioned above the principle polarization array face of the centered shunt slot arrays 32 and one-quarter wavelength (¼λ) below the notch dipole arrays 34. The notch radiators 52 intercept almost none of the currents flowing in the walls of the notch dipole arrays 34 due to the principle polarization array TEM parallel plate mode which subsequently leads to extremely low coupling between the two polarizations or arrays 32 and 34.

The probe coupling from the probe element 58 is located at the end of the notch dipole array 34 and at the ends of the centered shunt slot arrays 32 so that a minimal interference with the principle polarization array from the centered shunt slot arrays 32 occurs. The probe coupling approach requires only a small diameter hole to be positioned between adjacent rectangular waveguides 38 so that the probe element 58 can be passed down into the dipole array feed guide 56, shown in detail in FIG. 5. The probe element 58 has a natural reactance to it so that the use of inductive tuning or an inductive iris 80 along the feed guide 56 sidewalls 82 are used to cancel this reactance. Conductance can then be determined as a function of the iris 80 width or the amount of penetration of the iris 80 into the center of the feed guide 56 and the probe 58 penetration depth into the feed guide 56. There will generally be an insertion phase delay as a function of conductance, but this phase delay is preferably compensated by adjusting the length of the stripline feed 70 in each array 34 to provide a conductance range of about 2.5 to 1.

Figure 6:
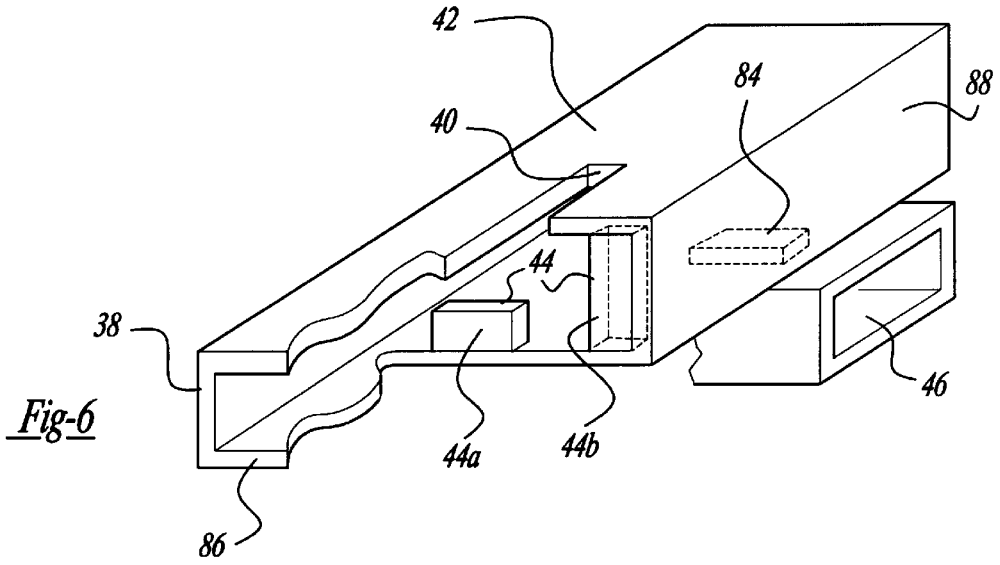
FIG. 6 is a side perspective view of a centered shunt slot array fed by an offset ridge resonant iris.

Turning now to FIG. 6, a detailed perspective view of a portion of the centered shunt slot array 32 is shown along with the slot array feed guide 46. As shown in FIG. 6, the rectangular waveguide 38 includes the centered longitudinal shunt slot 40 positioned on the broadwall 42 of the rectangular waveguide 38. Positioned substantially perpendicular to the waveguide 38, is the slot array feed guide 46 which includes a centered transverse feed slot 84 passing through both the feed guide 46 and the waveguide 38 in order to feed the waveguide 38. Positioned within the waveguide 38, as well as within the feed guide 46 are offset ridge resonant irises 44 which are disposed centrally under each longitudinal shunt slot 40, as well as the transverse slots 84. Each offset ridge resonant iris 44 is comprised of a first portion 44*a* that is disposed within the waveguide 38 on an opposite internal broadwall 86 of the waveguide 38 relative to the centered longitudinal shunt slot 40. The first portion 44*a* of the offset ridge resonant iris 44 has a length that is a predetermined portion of the width of the waveguide 38. Each offset ridge resonant iris 44 also has a second portion 44*b* that is disposed on an internal lateral sidewall 88 of the waveguide 38 relative to the slot 40. Each offset ridge resonant iris 44 has a finite thickness, typically or the order of about 16 to 25 mils when used to radiate energy in the Ka frequency band. A more detailed description of the resonant offset ridge iris 44 is described in a commonly assigned Application Ser. No. 09/058,112, entitled "Centered Longitudinal Shunt Slot Fed By a Resonant Offset Ridge Iris", naming as inventors Pyong K. Park and Sang H. Kim (Hughes Docket No. PD-96233), filed on Apr. 9, 1998, which is hereby incorporated by reference.

Figure 1:
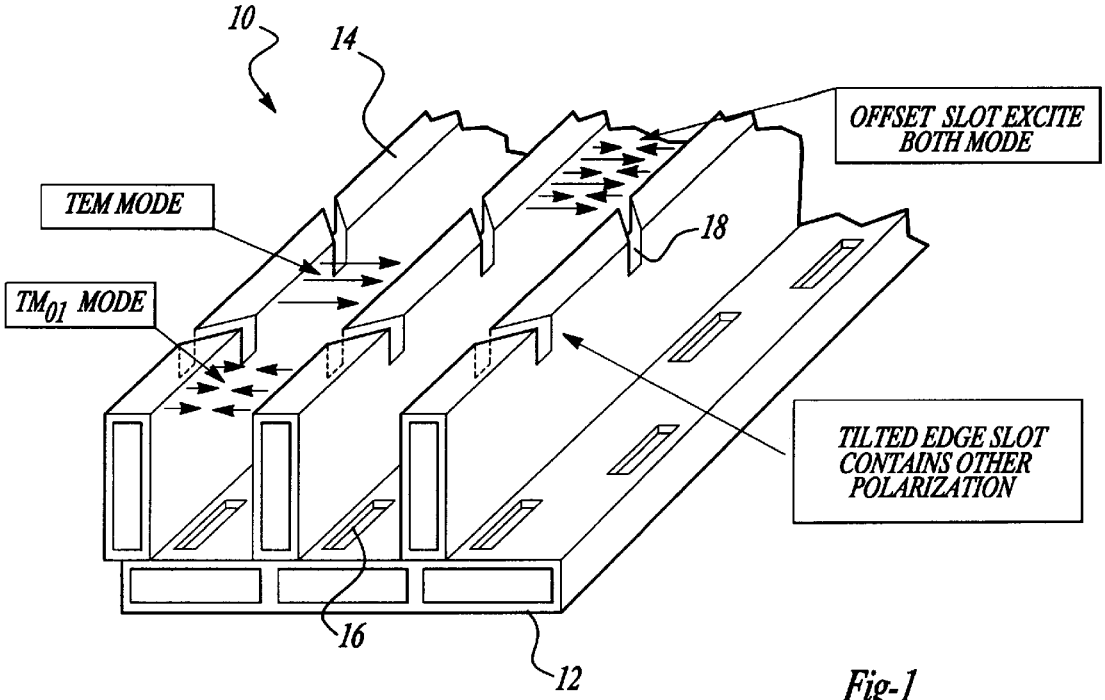
Fig-1 (Prior Art)
FIG. 1 is a side perspective view of a prior art rectangular waveguide fed offset longitudinal slot array and a waveguide fed titled edge slot array antenna.
Figure 2:
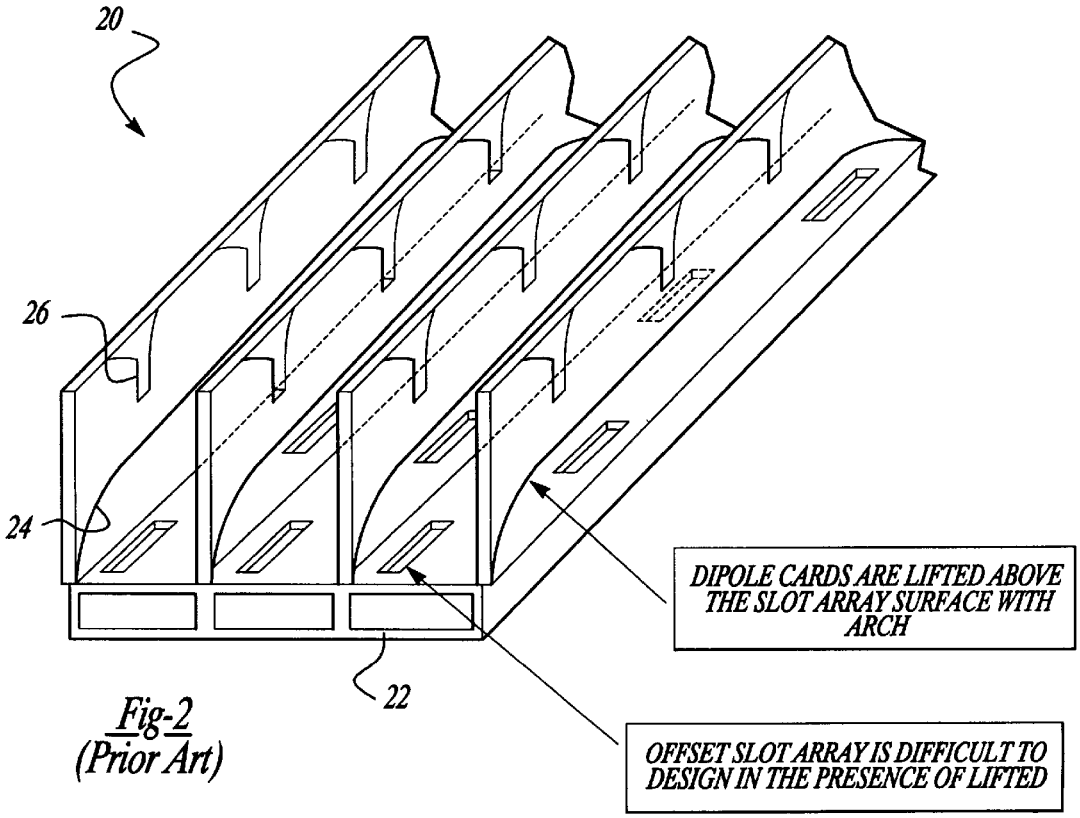
Fig-2 (Prior Art)
FIG. 2 is a side perspective view of a prior art arched notch dipole card array and a rectangular waveguide fed offset longitudinal slot array antenna.

Returning now to FIG. 3, an illustration of the intended performance exhibited by the dual polarization antenna array 30 will be discussed. The centered longitudinal shunt slots 40 of the shunt slot arrays 32 excite only the desirable TEM even mode, as shown in FIG. 1, within the parallel plate region of the notch dipole arrays 34. The centered shunt slots 40 do not excite the undesirable $TM_{01}$ odd mode, also shown in FIG. 1, which is caused by of the offset slots 16. The $TM_{01}$ odd mode excitation is a waste of energy and constitutes undesirable radiation because the $TM_{01}$ odd mode is not used for main beam radiation. The use of the centered longitudinal shunt slots 40 completely eliminates the $TM_{01}$ odd mode excitation compared with various prior art antennas which have prior restrictions of high side lobes and significant RF loss.

Significant system performance advantages can be achieved in radar and communication systems by use of the dual polarization antenna array 30. The dual polarization antenna array 30 provides the common aperture 36 fully populated with elements for both polarizations and also provide high gain and low sidelobe performance for both polarizations. Both arrays in this dual polarization antenna array 30 utilize the entire aperture 36 to maximize its antenna performance to realize both the principle polarization and the cross polarization arrays in efficient standing wave configurations. The high RF performance achieved by the dual polarization antenna array 30 provides low sidelobes, low RF loss and exceptional isolation between both arrays of the principle polarization and cross polarization below about −50 dB that may be applied to frequencies up to at least the Ka band or higher.

The foregoing discussion discloses and describes merely exemplary embodiments of the present invention. One skilled in the art would readily realize from such a discussion and from the accompanying drawings and claims, that various changes, modifications and variations can be made therein within departing from the spirit and scope of the invention as defined by the following claims:

What is claimed is:

1. A common aperture dual polarization antenna array comprising:

an antenna aperture;

a plurality of centered slot arrays positioned within said antenna aperture;

a plurality of notch dipole arrays positioned within said antenna aperture and positioned substantially orthogonal to said plurality of centered slot arrays;

a first feed guide coupled to said plurality of centered slot arrays; and a second feed guide coupled to said plurality of notch dipole arrays.

2. The common aperture dual polarization antenna array as defined in claim 1 wherein said plurality of centered slot arrays includes a plurality of rectangular waveguides, each of said rectangular waveguides including a plurality of centered slots, said plurality of centered slots substantially centered between adjacent notch dipole arrays.

3. The common aperture dual polarization antenna array as defined in claim 2 wherein said centered shunt slots are fed by offset resonant ridge irises.

4. The common aperture dual polarization antenna array as defined in claim 1 wherein said plurality of centered slot arrays excite TEM even mode without exciting $TM_{01}$ odd mode.

5. The common aperture dual polarization antenna array as defined in claim 1 wherein said plurality of notch dipole arrays includes a plurality of notch radiators and a plurality of dipole radiators.

6. The common aperture dual polarization antenna array as defined in claim 1 further comprising a polarization selective ground plane having a plurality of conductors extending substantially parallel to one another and substantially orthogonal to said plurality of notch dipole arrays, said polarization selective ground plane acting as a ground plane for said plurality of notch dipole arrays and being substantially transparent to said plurality of centered slot arrays.

7. A common aperture dual polarization antenna array comprising:

a principle polarization array having a plurality of principle polarized radiators operable to radiate principle polarized energy;

a cross polarization array having a plurality of cross polarized radiators operable to radiate cross polarized energy; and a polarization selective ground plane operable to simultaneously reflect substantially all of the cross polarized energy radiated from said plurality of cross polarized radiators and simultaneously pass substantially all of the principle polarized energy radiated from said plurality of principle polarized radiators.

8. The common aperture dual polarization antenna array as defined in claim 7 wherein said principle polarization array includes a plurality of rectangular waveguide fed longitudinal centered shunt slot arrays and said plurality of principle polarized radiators include a plurality of centered shunt slots.

9. The common aperture dual polarization antenna array as defined in claim 8 wherein each centered shunt slot is fed by an offset ridge resonant iris.

10. The common aperture dual polarization antenna array as defined in claim 7 wherein said cross polarization array includes a plurality of stripline fed notch dipole arrays and said plurality of cross polarized radiators include a plurality of notch radiators and dipole radiators.

11. The common aperture dual polarization antenna array as defined in claim 10 wherein each notch dipole array is fed with a stripline feed circuitry having a probe coupling element.

12. The common aperture dual polarization antenna array as defined in claim 11 wherein each probe coupling element is fed by a rectangular feed guide having tapered walls at each probe coupling element location to provide inductive tuning.

13. The common aperture dual polarization antenna array as defined in claim 7 wherein said polarization selective ground plane includes a plurality of conductive strips positioned substantially parallel with one another.

14. The common aperture dual polarization antenna array as defined in claim 13 wherein said polarization selective ground plane is positioned at about one-quarter wavelength (¼λ) below said cross polarization array.

15. A common aperture dual polarization antenna array comprising:

a plurality of rectangular waveguide fed centered shunt slot arrays, each of said centered shunt slot arrays including a rectangular waveguide and a plurality of centered shunt slots;

a plurality of stripline fed notch dipole arrays, each of said notch dipole arrays including a plurality of notch radiators and a plurality of dipole radiators; and wherein said plurality of centered shunt slot arrays and said plurality of notch dipole arrays share a common aperture.

16. The common aperture dual polarization antenna array as defined in claim 15 further comprising a polarization selective ground plane operable to simultaneously reflect substantially all energy radiated from said plurality of notch dipole arrays and simultaneously pass substantially all energy radiated from said plurality of centered shunt slot arrays.

17. The common aperture dual polarization antenna array as defined in claim 16 wherein said polarization selective ground plane is positioned about one-quarter wavelength (¼λ) below said plurality of notch dipole arrays.

18. The common aperture dual polarization antenna array as defined in claim 15 wherein each of said centered shunt slots is fed by an offset ridge resonant iris.

19. The common aperture dual polarization antenna array as defined in claim 18 wherein each of said offset ridge resonant irises includes a first iris element and a second iris element separated from one another and substantially centered below each of said centered shunt slots.

20. The common aperture dual polarization antenna array as defined in claim 15 wherein each of said notch dipole arrays is fed by stripline feed circuitry, each stripline feed circuitry including a probe coupling element, each probe coupling element extending into a feed guide, wherein said feed guide includes inductive tuning at each probe coupling element.

* * * * *